US007165731B2

(12) United States Patent
Cotton, III

(10) Patent No.: US 7,165,731 B2
(45) Date of Patent: Jan. 23, 2007

(54) DUAL TRAVEL SEATED PIN VALVE ASSEMBLY

(75) Inventor: Clifford E. Cotton, III, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 535 days.

(21) Appl. No.: 10/209,218

(22) Filed: Jul. 31, 2002

(65) Prior Publication Data

US 2004/0021002 A1 Feb. 5, 2004

(51) Int. Cl.
*F02M 47/02* (2006.01)

(52) U.S. Cl. ..... 239/88; 239/92; 239/533.2; 239/585.1; 239/102.2; 137/625.27; 137/625.65; 251/129.18

(58) Field of Classification Search ..... 239/88–96, 239/102.2, 124, 533.3–533.4, 533.8, 585.1, 239/585.2, 585.3, 585.4, 585.5; 251/129.19, 251/360, 129.18; 137/625.27 X, 625.65 X
See application file for complete search history.

(56) References Cited

U.S. PATENT DOCUMENTS 3,016,920 A * 1/1962 Thomsen et al. ..... 137/625.65
3,538,954 A * 11/1970 Bowsher et al. ..... 137/625.65
4,175,587 A * 11/1979 Chadwick et al. ..... 137/625.65
5,289,841 A * 3/1994 Maranzano ..... 137/1
5,605,134 A 2/1997 Martin
5,711,279 A * 1/1998 Green et al. ..... 123/506
5,853,028 A * 12/1998 Ness et al. ..... 137/625.65
6,237,857 B1 * 5/2001 Ausman et al. ..... 239/5
6,390,385 B1 * 5/2002 Hardy et al. ..... 239/102.2

* cited by examiner

*Primary Examiner*—Dinh Q. Nguyen
(74) *Attorney, Agent, or Firm*—Liell & McNeil

(57) ABSTRACT

When an engine is cold-started, the engine oil is quite viscous and requires larger passageways to flow through the engine than when the engine is warmed up and the engine oil flows readily. The present invention relates to a pin valve assembly which may be used on a fuel injector of an engine. The pin valve assembly of the present invention includes a movable shuttle which allows for a relatively large fluid flow space within the pin valve assembly when the engine is cold, and then moves to reduce the fluid flow space when the engine oil is less viscous and requires less room to flow as desired. Therefore, the advantages of a relatively large fluid flow space as well as a shorter pin travel distance within the pin valve assembly are both preserved.

19 Claims, 2 Drawing Sheets

DUAL TRAVEL SEATED PIN VALVE ASSEMBLY

TECHNICAL FIELD

This invention relates to a pin valve and, more particularly, to a pin valve assembly in which at least one of the seats of the valve is movable to better control cold-start oil flow in a hydraulically-actuated fuel injector.

BACKGROUND

Pin valves are well-known in the art. This type of valve usually consists of a housing, a pin which travels back and forth within the housing to contact a seat at either end of the housing, a pin actuator to move the pin in a first direction, and a biasing spring to move the pin in a second direction. Fluid flows around the pin and into the housing from a preferably pressurized source when the pin is moved in the first direction, and the fluid flows from the housing, around the pin, and to a destination when the pin is moved in a second direction.

The above-described pin valve is commonly used in a fuel injector to aid the fuel injector's operation in a known manner by controlling the flow of engine oil to the fuel injector. While this prior art pin valve generally works well, there are some disadvantages in fluid control during a "cold start", when the engine is completely cool. This happens quite often, for instance, when the engine is being started for the first time that day or after a few hours' rest.

It is important for the engine oil to be able to flow through the fuel injector at a predetermined rate, as the fuel injector's lubrication and performance characteristics are based on that predetermined rate. The predetermined rate is based on a certain viscosity value of the engine oil after the engine is "warned up". Because the engine oil is very viscous and slow-flowing during a cold start, it does not flow through the pin valve as readily as when the engine is warmed up and the oil has a reduced viscosity from the engine's heat. The reduction of flow during a cold start can lead to lubrication and oil pressure problems within the fuel injector. Since solving this cold start problem by using less viscous oil would result in the warm oil being too thin to function as desired during most of the total operating time of the engine, it is desirable to instead route a larger volume (possibly via a higher flow rate) of the currently-used engine oil through the pin valve while the engine is cold than when the engine warms up. Currently the flow rate of the engine oil through the pin valve cannot be changed as the engine warms up.

Additionally, the dimensions of the pin valve and the fuel injector change minutely as the engine warms up, causing the metal to expand, and these dimension changes can alter the behavior of the valve and thus the oil, as well.

The present invention is directed to overcoming one or more of the problems as set forth above.

SUMMARY OF THE INVENTION

In an embodiment of the present invention, a dual travel seated pin valve assembly is disclosed. The assembly includes a pin having a first pin end, a second pin end, and a pin midsection located between the first and second pin ends and being of larger cross-section than the first and second pin ends The pin defines a pin travel axis and the pin is adapted to travel between a first pin position and a second pin position. The assembly also includes a stationary pin seat located near the second pin end; and a movable shuttle located near the first pin end and spaced along the pin travel axis from the stationary pin seat, and adapted to move selectively along the pin travel axis between a first shuttle position and a second shuttle position. The assembly also includes a pin actuator adapted to move the pin and a shuttle actuator adapted to move the shuttle.

In an embodiment of the present invention, a method of controlling a fluid flow space using a pin adapted to move between a first pin position and a second pin position, a stationary seat, a movable shuttle adapted to move between a first shuttle position and a second shuttle position, a pin biasing member, a latching mechanism, a pin actuator, and a shuttle actuator is disclosed. The method includes the steps of: providing the fluid flow space, controlling the pin actuator to move the pin to the first pin position, contacting the stationary seat with the pin at the first pin position, and controlling the shuttle actuator to move the movable shuttle between the first and second shuttle positions to reduce the fluid flow space.

In an embodiment of the present invention, a hydraulically-actuated fuel injector is disclosed. The fuel injector includes a control portion, a hydraulic pressurizing portion, a nozzle portion, and a seated pin valve. The seated pin valve includes a pin having a first pin end, a second pin end, and a pin midsection located between the first and second pin ends and being of larger cross-section than the first and second pin ends The pin defines a pin travel axis and the pin is adapted to travel between a first pin position and a second pin position. The seated pin valve also includes a stationary pin seat located near the second pin end; and a movable shuttle located near the first pin end and spaced along the pin travel axis from the stationary pin seat, and adapted to move selectively along the pin travel axis between a first shuttle position and a second shuttle position. The seated pin valve also includes a pin actuator adapted to move the pin and a shuttle actuator adapted to move the shuttle.

DETAIL DESCRIPTION

Figure 1:
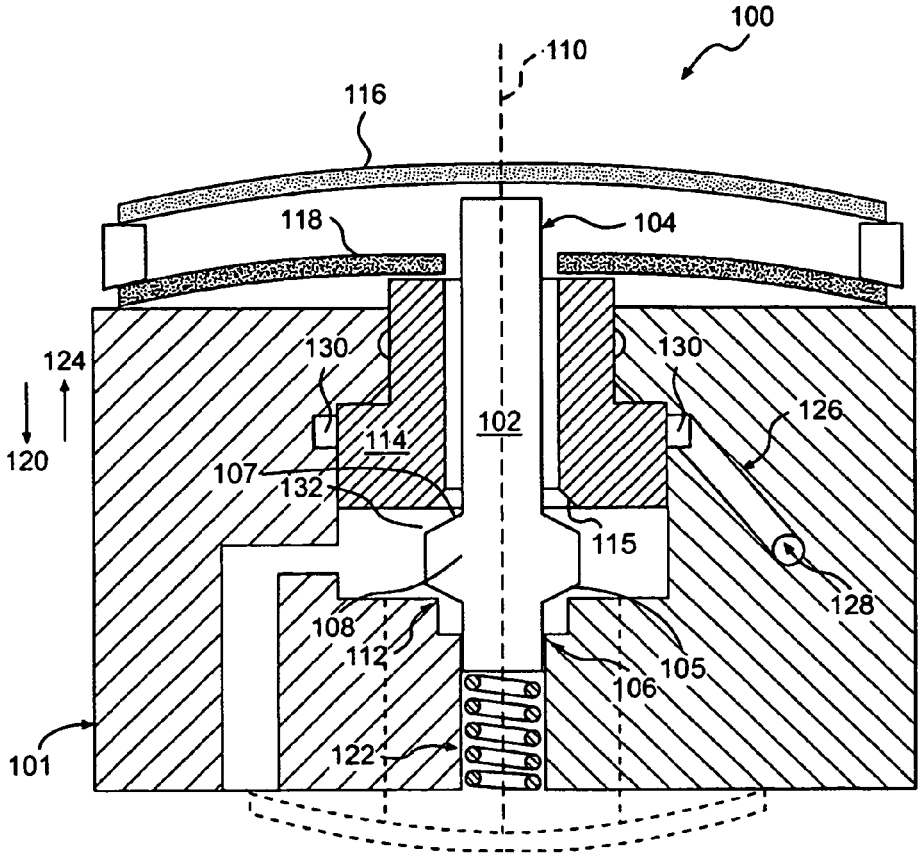
FIG. 1 is a cutaway plan view of a dual travel seated pin valve assembly of an embodiment of the present invention.

FIG. 1 discloses a pin valve assembly 100 according to the present invention which includes a valve body 101. The pin valve assembly 100 includes a pin 102 having a first pin end 104 and a second pin end 106. A pin midsection 108 is between the first and second pin ends 104,106. The pin midsection 108 preferably has a larger cross-section than the rest of the pin 102. The pin midsection 108 is bounded by a first contact surface 105 and a second contact surface 107.

The pin 102 defines a pin travel axis 110. A stationary pin seat 112 is located near the second pin end 106. A movable shuttle 114 is located near the first pin end 104. The stationary pin seat 112 and movable shuttle 114 are spaced apart along the pin travel axis 110.

A pin actuator 116 is located near the first pin end 104 and is operative to operative to selectively move the pin 102 in a first travel direction 120, shown in FIG. 1 at an intermediate position, to a first pin position. at which first contact surface 105 is in contact with lower seat 112. Depending upon the actuation state of pin actuator 116, pin 102 can be moved upward such that second contact surface 107 is in contact with upper seat 115 of movable shuttle 114. A shuttle actuator 118 is located near the first pin end 104 as well, and is operable to selectively move the movable shuttle 114 in the first travel direction 120 from a first shuttle position (shown in FIG. 1) to a second shuttle position. The pin and shuttle actuators 116,118 may be solenoids, levers, pistons, or the like, but are shown in FIG. 1 as being piezoelectric benders or armatures as fully disclosed in U.S. Ser. No. 09/625,941, filed on Jul. 26, 2000 and entitled "Manually Operated Coupler for Work Tools" [Caterpillar Inc. docket # 99-398]. The precise nature of the pin and shuttle actuators 116,118 is not essential to the present invention, so long as they are operable to move the pin 102 and movable shuttle 114 as described below.

Advantageously, a pin biasing member 122, shown in FIG. 1 as a spring, is operable to move the pin 102 in a second travel direction 124 to a second pin position. This biasing function can be accomplished through positive pressure as provided by the spring shown, or by any other method, including a modification to the pin actuator 116 to "pull" the pin 102 back after the pin actuator 116 "pushes" the pin 102 in the first travel direction 120.

Preferably, a latching mechanism 126 is operable to hold the movable shuttle 114 in the second shuttle position. The latching mechanism 126 is shown in FIG. 1 as being a hydraulic system, wherein a pressure source 128 provides pressurized fluid to fill a latching volume (shown partially at 130 and expanded when movable shuttle 114 is in the second shuttle position, not shown). The latching volume 130, when containing fluid, acts to block the movable shuttle 114 from returning to the first shuttle position.

Figure 2:
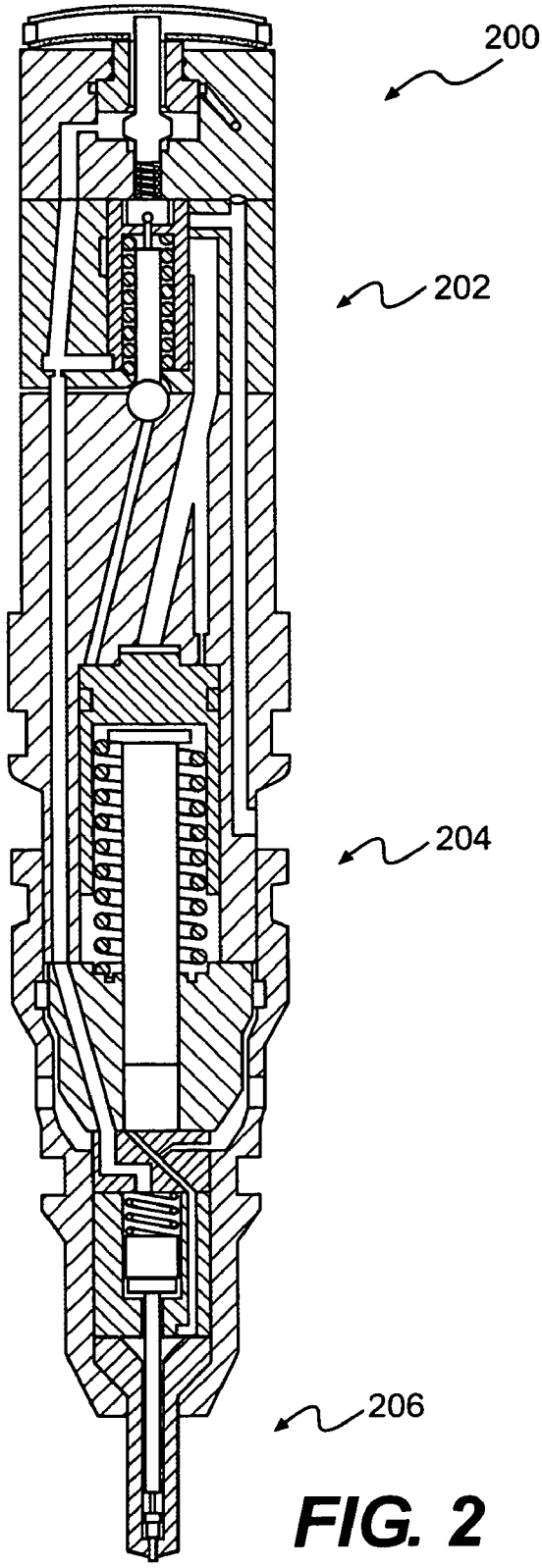
FIG. 2 is a cutaway plan view of a fuel injector including a dual travel seated pin valve assembly of an embodiment of the present invention.

FIG. 2 depicts the pin valve assembly 100 of the present invention in the environment of a fuel injector 200. The fuel injector 200 shown in FIG. 2 is of a known type commonly referred to as "hydraulically-actuated". The fuel injector 200 has a control portion 202, a hydraulic pressurizing portion 204, and a nozzle portion 206.

While aspects of the present invention have been particularly shown and described with reference to the preferred embodiment above, it will be understood by those skilled in the art that various additional embodiments may be contemplated without departing from the spirit and scope of the present invention. For example, the pin valve assembly may be used in any suitable fluid flow control application, the biasing member may be of a different style or type, or the movable shuttle may have three or more positions actuated by similar mechanisms. However, a device or method incorporating such an embodiment should be understood to fall within the scope of the present invention as determined based upon the claims below and any equivalents thereof.

INDUSTRIAL APPLICABILITY

When an engine is first cold-started, the engine oil is thicker and needs more room to flow within the pin valve assembly 100 than when the engine is warmed up. The present invention controls a fluid flow space 132 by moving a movable shuttle 114 from a first shuttle position along a pin travel axis 110 to a second shuttle position.

As the fuel injector 200 operates in a "cold" position, the movable shuttle 114 is in the first shuttle position, as shown in FIG. 1. The pin 102 is moved back and forth between a first pin position, in which the pin midsection 108 contacts the stationary pin seat 112, and a second pin position, in which the pin midsection 108 contacts the movable shuttle 114 (initially as the movable shuttle 114 is in the first shuttle position). This motion is controlled and provided by the pin actuator 116 and the pin biasing member 122. The pin 102 moves back and forth repeatedly to control engine oil flow. Because the engine oil is still in its more-viscous "cold" state, a larger fluid flow space 132 is needed to supply adequate oil flow to the fuel injector 200. That larger fluid flow space 132 is provided by the first shuttle position.

As the engine warms up, the oil becomes less viscous and flows more easily, thus eliminating the need for a larger fluid flow space 132. Once the engine reaches a predetermined temperature, the shuttle actuator 118 provides a force to move the movable shuttle 114 from the first shuttle position to the second shuttle position. The determination of the engine's "warm" state may be done by a measured temperature of a certain component or area, a measured time from a certain event, or by any other suitable method.

Regardless of the method used, once the triggering event occurs, the shuttle actuator 118 acts once to move the movable shuttle 114 from the first shuttle position to the second shuttle position. The movable shuttle 114 travels along the pin travel axis 110 toward the stationary pin seat 112 to decrease the fluid flow space 132. The pin 102 then continues its reciprocal motion between the first pin position, where the pin midsection 108 contacts the stationary pin seat 112, and the now-modified second pin position, where the pin midsection 108 contacts the movable shuttle 114 as the movable shuttle 114 is in the second shuttle position.

The total travel distance of the pin 102 between the stationary pin seat 112 and the movable shuttle 114 is reduced when the movable shuttle 114 is moved to the second shuttle position. This reduced distance is desirable because the pin 102 develops less inertia traveling over the smaller distance. The result of this decreased inertia is that lower forces are transferred and less wear on the pin 102, the movable shuttle 114, and the stationary pin seat occurs than if the larger distance necessary mainly to accommodate oil flow at cold start is maintained throughout the entire running period of the engine. Also, the reduced travel distance allows for quicker response of the pin 102 to differing pin actuator 116 timing and results in high control of variability in the pin valve assembly 100.

Should the movable shuttle 114 fail to move to the second shuttle position at the appointed time for some reason, no harm to the engine occurs; the injector is simply less efficient and the malfunction can be fixed at a convenient time. Since the shuttle actuator 118 is only used once per cold start, a less robust, and therefore less expensive, shuttle actuator 118 component may be used, such as the aforementioned piezoelectric bender rather than a solenoid valve. It is advantageous for the shuttle actuator 118 to actuate simultaneously with the pin actuator 116 to avoid interference between the movable shuttle 114 and the pin 102, but this is not necessary to the proper operation of the present invention. Finally, the stationary pin seat 112 may be replaced with a second movable shuttle (as shown in shadow in FIG. 1), actuated in much the same manner as that described herein, without changing the spirit and scope of the present invention.

Preferably, when the movable shuttle 114 is moved to the second shuttle position, it is held there by the latching mechanism 126 and the shuttle actuator 118 need not be actuated again until the next cold start condition occurs. The latching mechanism 126 may be a lever, magnet, clip, or any other suitable device. In the embodiment shown in FIG. 1, a fluid supplied by the pressure source 128, which might be a high pressure rail as shown, fills the latching volume 130 and an additional area (not shown) vacated by the movable shuttle 114. In the shown embodiment, the fluid does not drain from the latching volume 130 until the engine is turned off and the rail pressure abates, allowing the fluid to drain back to a tank. Once the latching volume 130 is substantially vacated by the fluid, the pin biasing member 122 exerts a positive pressure on the pin 102 sufficient to overcome the latching mechanism 126, and the pin biasing member 122 pushes the movable shuttle 114 back to the first shuttle position through contact between the movable shuttle 114 and the pin midsection 108. The engine then may be cold-started again and the process repeats as needed.

If the engine is simply temporarily stopped and is turned on again in time to substantially maintain the rail pressure, the restart is not considered a "cold start" and the movable shuttle 114 remains in the second shuttle position. Generally, a prompt restart of this type will result in the engine oil remaining warm and the cold start compensation of the movable shuttle 114 is not needed.

The apparatus and method of certain embodiments of the present invention, when compared with other methods and apparatus, may have the advantages of: facilitating efficient fluid flow in cold start conditions, and being more economical to manufacture and use. Such advantages are particularly worthy of incorporating into the design, manufacture, and operation of fuel injectors. In addition, the present invention may provide other advantages that have not been discovered yet.

It should be understood that while a preferred embodiment is described in connection with a fuel injector, the present invention is readily adaptable to provide similar functions in other applications. Other aspects, objects, and advantages of the present invention can be obtained from a study of the drawings, the disclosure, and the appended claims.

What is claimed is:

1. A dual travel seated pin valve assembly, comprising:

a valve body defining a lower seat;

a shuttle body defining an upper seat;

a pin having a first contact surface and a second contact surface and movable along a pin axis between the lower seat and the upper seat;

a pin actuator operative to selectively move the pin along the pin axis;

wherein the shuttle body is movable between a first shuttle position and a second shuttle position along the pin axis; and a shuttle actuator, wherein the shuttle actuator selectively actuates to move the shuttle body between the first shuttle position and the second shuttle position.

2. The dual travel seated pin valve assembly of claim 1, wherein the first contact surface contacts the lower seat when the pin is in a first pin position.

3. The dual travel seated pin valve assembly of claim 1, wherein the second contact surface contacts the upper seat when the pin is in a second pin position.

4. The dual travel seated pin valve assembly of claim 1, wherein the pin has a first pin end, a second pin end spaced apart from the first pin end along the pin axis, and a pin midsection located between the first and second pin ends, and wherein the pin midsection is of larger cross-section than the first and second pin ends, thereby forming the first and second contact surfaces.

5. The dual travel seated pin valve assembly of claim 2 wherein the pin actuator selectively actuates to move the pin toward the first pin position.

6. The dual travel seated pin valve assembly of claim 3, including a pin biasing member, wherein the pin biasing member provides a force adapted to move the pin toward the second pin position.

7. The dual travel seated pin valve assembly of claim 6, wherein the pin biasing member is a spring.

8. The dual travel seated pin valve assembly of claim 1, wherein the shuttle actuator is of a type selected from the group consisting of levers, pistons, solenoids, and piezoelectric devices.

9. The dual travel seated pin valve assembly of claim 1, including a latching mechanism adapted to retain the shuttle body in the second shuttle position.

10. A dual travel seated pin valve assembly, comprising:

a valve body defining a lower seat;

a shuttle body defining an upper seat;

a pin having a first contact surface and a second contact surface and movable alone a pin axis between the lower seat and the upper seat;

wherein the shuttle body is movable between a first shuttle position and a second shuttle position along the pin axis;

a shuttle actuator, wherein the shuttle actuator selectively actuates to move the shuttle body between the first shuttle position and the second shuttle position;

a latching mechanism adapted to retain the shuttle body in the second shuttle position; and wherein the latching mechanism is a hydraulic latch.

11. A dual travel seated pin valve assembly, comprising:

a valve body;

a first movable shuttle body defining an upper seat;

a second movable shuttle body defining a lower seat;

a pin having a first contact surface and a second contact surface and movable along a pin axis between the lower seat and the upper seat; and wherein the first shuttle body is movable between a first shuttle position and a second shuttle position along the pin axis.

12. A method of controlling a fluid flow space, comprising:

defining the fluid flow space within a valve body between an upper seat and a lower seat;

moving at least one of the upper seat and the lower seat by energizing a shuttle actuator;

changing a volume of the fluid flow space; and moving a pin toward one of the upper seat and the lower seat by energizing a pin actuator.

13. The method of claim 12, including:

moving the pin to a first position;

contacting the lower seat with the pin;

moving the pin to a second position; and contacting the upper seat with the pin.

14. A hydraulically-actuated fuel injector, comprising:

a seated pin valve, including:

a pin adapted to travel between a first pin position and a second pin position;

a pin actuator operative to selectively move the pin along the pin axis;

a valve body defining a lower seat at the first pin position;

a shuttle body defining an upper seat at the second pin position and adapted to move between a first shuttle position and a second shuttle position; and a shuttle actuator adapted to move the movable shuttle between the first shuttle position and the second shuttle position.

15. The hydraulically-actuated fuel injector of claim 14, wherein valve body includes a lower shuttle body defining the lower seat and adapted to move between a first lower shuttle position and a second lower shuttle position.

16. The hydraulically-actuated fuel injector of claim 14, wherein the pin includes a first contact surface and a second contact surface, and the first contact surface contacts the lower seat when the pin is at the first pin position, and the second contact surface contacts the upper seat when the pin is at the second pin position.

17. The hydraulically actuated fuel injector of claim 14, wherein the shuttle actuator is of a type selected from the group consisting of levers, pistons, solenoids, and piezoelectric devices.

18. The hydraulically actuated fuel injector of claim 14, including a latching mechanism adapted to retain the shuttle in the second shuttle position.

19. The hydraulically actuated fuel injector of claim 14, wherein the pin actuator is of a type selected from the group consisting of levers, pistons, solenoids, and piezoelectric devices.

* * * * *